US006041773A

United States Patent [19]

Rosenquist

[11] Patent Number: 6,041,773

[45] Date of Patent: Mar. 28, 2000

[54] CAMP STOVE WARMING OVEN

[76] Inventor: Robert Rosenquist, 4402 E. Kings Ave., Phoenix, Ariz. 85032

[21] Appl. No.: 09/363,117

[22] Filed: Jul. 28, 1999

[51] Int. Cl.[7] ..... A21B 1/52; F24C 1/16

[52] U.S. Cl. ..... 126/275 R; 126/9 R; 126/41 R

[58] Field of Search ..... 126/9 R, 38, 41 R, 126/25 R, 273 R, 275 R, 9 B, 285 R, 29, 30

[56] References Cited

U.S. PATENT DOCUMENTS

| | | | |
|---|---|---|---|
| 675,911 | 6/1901 | Tipley | 126/275 R |
| 2,189,875 | 2/1940 | Barllebauth . | |
| 2,665,682 | 1/1954 | Easter . | |
| 3,308,807 | 3/1967 | Little . | |
| 4,051,837 | 10/1977 | Norman . | |
| 4,920,950 | 5/1990 | Johnson | 126/9 R |
| 5,711,210 | 1/1998 | Kaufman . | |
| 5,891,498 | 4/1999 | Boehler . | |

FOREIGN PATENT DOCUMENTS

| | | | |
|---|---|---|---|
| 1156 | of 1912 | United Kingdom | 126/275 R |
| 553002 | 5/1943 | United Kingdom | 126/275 R |

*Primary Examiner*—James C. Yeung
*Attorney, Agent, or Firm*—LaValle D. Ptak

[57] ABSTRACT

A camp stove warming oven is designed in the form of a hollow, rectangular enclosed box having a top, bottom and four sides. One of the sides is hingedly attached to the main body portion of the oven to permit access to the interior. The bottom of the oven has apertures through it to permit hot air to rise from below the oven into the interior. Foldable legs are provided to permit placement of the oven over the top of an outdoor camp stove at a pre-established height, typically on the order of 17". This permits the camp stove to be used in its intended manner for the cooking of food. Waste heat from the stove then rises and heats the interior of the oven, which may be used as a warming oven, to keep foods warm while additional food is being cooked on the burners of the stove.

14 Claims, 2 Drawing Sheets

CAMP STOVE WARMING OVEN

BACKGROUND

Portable camp stoves are in widespread use by campers for preparing foods at a camp site. Typically, such camp stoves include a pair of burners, a fuel supply, and a collapsible shield to shield three sides of the stove from breezes. Very often, in the use of a camp stove, both burners are actively involved in the preparation of at least a portion of the meal. When this portion is completed, it then is set aside while additional food is cooked, until the entire meal is completed. Camp stoves generally do not include any oven; so that it is difficult to keep earlier prepared food warm, while the remainder of the meal is completed on the limited number of burners on the stove.

Attempts have been made to provide an oven function for use in conjunction with camp stoves. Three patents which are directed to such devices are the Little U.S. Pat. No. 3,308,807; Norman U.S. Pat. No. 4,051,837; and Boehler U.S. Pat. No. 5,891,498. In all of the ovens which are disclosed in these patents, the design is such that the heat from the burners of the stove is applied directly to the oven; so that the stove is converted from a stove with top burners to an oven. Consequently, when the oven is used, the stove cannot function for its normal purpose. The ovens of these patents sit directly on top of or very near the burners, and the stove is precluded from its normal function so long as the conversion to an oven is in effect. Portable ovens for use in camping or comparable environs also are disclosed in the Bartlebauth U.S. Pat. No. 2,189,875; Eastep U.S. Pat. No. 2,665,682 and Kaufman U.S. Pat. No. 5,711,210. All of these patents are directed to portable oven devices which are dedicated for use as stand-alone ovens; although they are portable. No combination of a stove and oven is disclosed in any of these patents.

It is desirable to provide a warming oven for a conventional camp stove which utilizes the waste heat from the stove when it is used in its conventional configuration to cook food; so that earlier cooked food may be kept warm while later food is being prepared.

SUMMARY OF THE INVENTION

It is an object of this invention to provide an improvement for portable stoves.

It is another object of this invention to provide an improvement for use with a camp stove.

It is an additional object of this invention to provide a warming oven for use with a portable stove.

It is a further object of this invention to provide a warming oven for placement above the burners of a camp stove when it is used in its conventional manner to utilize waste heat from the stove.

In accordance with a preferred embodiment of the invention, a warming oven for a camp stove comprises a main oven enclosure. This enclosure is constructed to allow heat transfer from an external source, such as a camp stove, to the interior of the oven enclosure. The enclosure also is designed to overlie at least one stove burner. A closable access door is placed in the main oven enclosure to permit placement of items into the enclosure and permit removal of items from the enclosure. Leg members on the oven enclosure space it a predetermined distance above the stove burner when the oven is in use, to allow use of the stove burner to cook food thereon.

DETAILED DESCRIPTION

Reference now should be made to the drawings, which are directed to a preferred embodiment of a camp stove warming oven 10. As illustrated particularly in FIGS. 1 and 2, the camp stove warming oven is constructed in the form of a hollow, elongated, rectangular box having four sides 12, 14, 16 and 22, a top 18 and a bottom 20.

Figure 1:
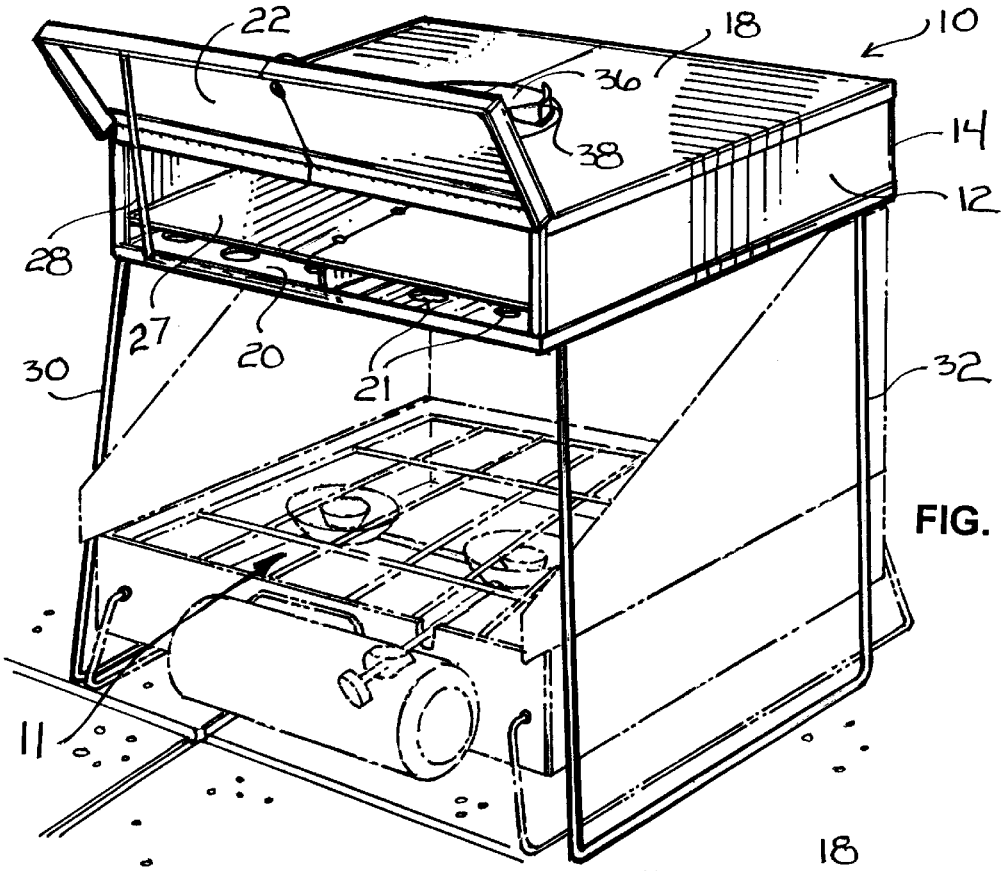
FIG. 1 is top front perspective view of a preferred embodiment of the invention showing its manner of use.
Figure 2:
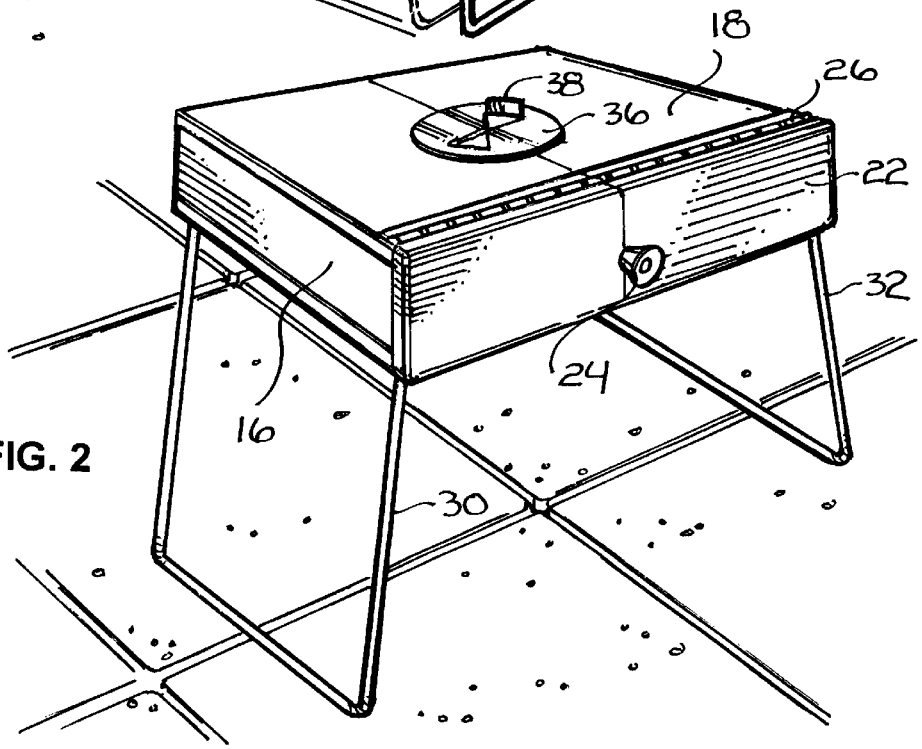
FIG. 2 is a top front perspective view of the embodiment shown in FIG. 1 showing a different mode of operation and illustrating the embodiment from a different angle.
Figure 4:
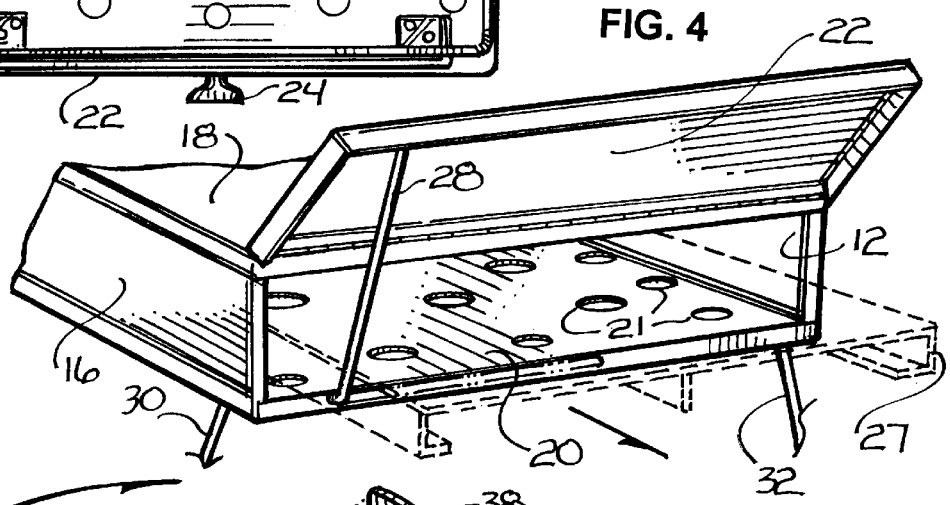
FIG. 4 is an enlarged detail of a portion of the embodiment shown in FIG. 1.

The front side 22 is a closable door hinged by means of a piano hinge 26, or other suitable hinge member, along its top edge to the top 18. The door 22 is moved by means of a handle 24 from a closed position, shown in FIG. 2, to an open position as shown in FIGS. 1 and 4. When the door 22 is in its open position, a movable support rod 28 may be moved to the position shown in FIGS. 1 and 4 to hold the door 22 open. When the door 22 is closed, the support rod 28 is moved to the dotted line position shown in FIG. 4; so that it is available for subsequent use and allows the door 22 to close. Since the door 22 is hinged by the hinge 26 along its upper edge, gravity closure typically is sufficient to hold it in its closed position. If desired, however, positive latches of a variety of conventional types could be used to hold the door 22 closed.

Figure 3:
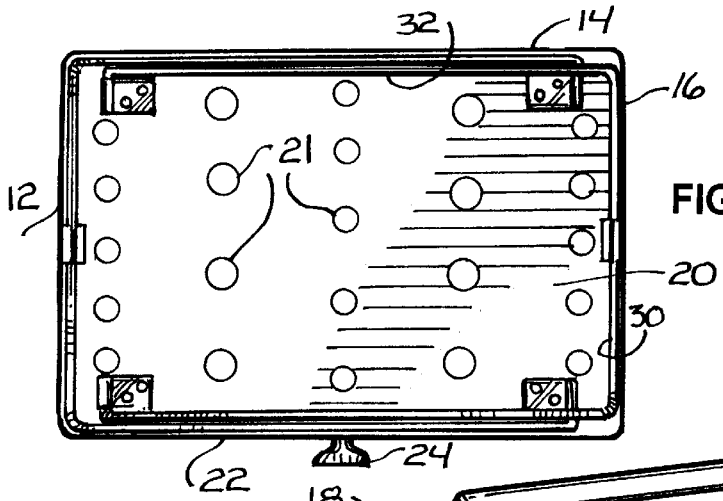
FIG. 3 is a bottom view of the embodiment shown in FIG. 1.
Figure 5:
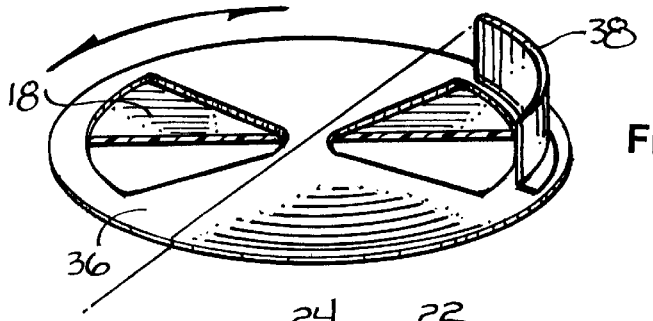
FIG. 5 is a detail of a portion of the embodiment shown in FIG. 1.

As may be ascertained from an examination of FIGS. 1, 3 and 4, the bottom 20 of the warming oven 10 has a number of circular openings or perforations 21 formed through it. These openings are selected to allow waste heat from a camp stove (shown in dotted lines as stove 11 in FIG. 1) located below the oven, to rise and enter the oven interior. A vent 36 is formed in the top of the oven to allow air to flow from the holes 21, through the oven interior, and out through the vent 36. The vent 36 is adjustable over an aperture in the top 18 of the oven to vary the amount of heat which is allowed to escape. This is shown as a typical rotating vent, illustrated in detail in FIG. 5, which may be rotated in either direction to open or close the aperture by use of a handle 38. As a consequence, the air flow through the oven may be adjusted, and therefore, the interior temperature may be adjusted as desired.

In order to most effectively utilize the oven, a shelf 27, shown most clearly in FIG. 1, is spaced a short distance above the bottom 20 of the oven. This shelf also is spaced from the front and sides (and, if desired, also the back) in order to allow the free flow of air around the edges of the shelf into the oven interior from the apertures 21 in the bottom 20 of the oven. The shelf 27 may either be permanently attached by any suitable means to the bottom 20 of the oven, or it may be a removable, slidable shelf, as indicated in dotted lines in FIG. 4. Either way, the function and use of the shelf 27 is the same. Food items to be kept warm may be placed on the shelf 27. Typically, the height of the side walls 12, 14, 16 and 22 is selected to be between 4" and 8" for a typical configuration of the oven. The rectangular dimensions of the top 18 and bottom 20 are selected to conform generally with the overall rectangular dimensions of the top of a conventional camp stove 11, with which the oven is to be used.

In order to utilize the oven to employ waste heat from the burners of the stove 11, it is spaced above the top of the stove 11 by means of a pair of folding or extendable U-shaped leg members 30 and 32, as shown in FIGS. 1, 2, 6 and 7. In the extended position shown in FIGS. 1 and 2, the leg members 30 and 32 cause the bottom 20 of the oven to be located approximately 10" to 20" over the top of the camp stove 11. Ideally, the design of the oven and the length of the legs 32 is selected to cause the wind shield provided with the camp stove 11, and illustrated in dotted lines in FIG. 1, to extend just below the lower surface of the bottom 20 of the oven. In addition to operating to capture the waste heat from the burners on the stove 11, the oven then further functions to protect the burners from the wind even more effectively than is accomplished by the use of the fold-out back and side shield members typically employed in conjunction with a camp stove 11.

Figure 6:
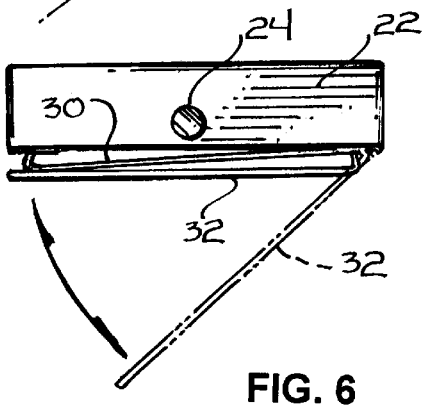
FIGS. 6 and 7 are front views of the embodiment shown in FIG. 1 illustrating a feature of the invention.
Figure 7:
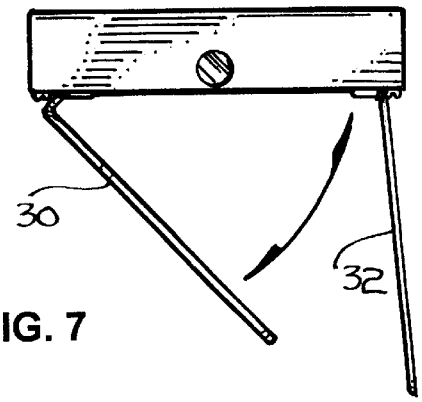

As illustrated in FIGS. 3, 6 and 7, the U-shaped legs 30 and 32 are hinged at their upper ends to the bottom 20 of the warming oven. They are folded in the storage position to overlie the bottom 20, as illustrated in FIGS. 3 and 6 in solid lines; so that the oven 10 is folded up into a compact configuration for storage and carrying.

FIGS. 6 and 7 illustrate the manner in which the legs 30 and 32 are folded downwardly and outwardly from the storage position adjacent the bottom 20 of the oven to the use position where they extend downwardly and slightly outwardly from the sides of the oven to provide a stable support for the oven over a camp stove. The legs are folded outwardly in the direction of the arrows shown in FIGS. 6 and 7 from the storage location shown in FIG. 6 to the use location shown in FIG. 7. When the oven is in its storage configuration as illustrated in FIGS. 3 and 6, the interior may be used to store camping essentials, such as plates, pans, food and the like. Consequently, the space may be utilized effectively during the transportation of the oven 10 and the stove 11 to and from the camp site.

FIGS. 6 and 7 illustrate the manner in which the legs 30 and 32 are folded downwardly and outwardly from the storage position adjacent the bottom 20 of the oven to the use position where they extend downwardly and slightly outwardly from the sides of the oven to provide a stable support for the oven over a camp stove. The legs are folded outwardly in the direction of the arrows shown in FIGS. 6 and 7 from the location shown in FIG. 6 to the use location shown in FIG. 7.

The foregoing description of the preferred embodiment of the invention is to be considered as illustrative only, and not as limiting. Various changes and modifications will occur to those skilled in the art for performing substantially the same function, in substantially the same way, to achieve substantially the same result, without departing from the true scope of the invention as defined in the appended claims.

What is claimed is:

1. A warming oven for a camp stove including in combination:

a main oven enclosure constructed to allow heat transfer from an external source to the interior thereof and designed to overlie at least one stove burner the main oven enclosure being fabricated in the form of a substantially hollow rectangular box having a top, four sides and a bottom with apertures therein to facilitate the transfer of heat rising from a stove burner through the apertures to the interior of the main oven enclosure;

a closable access door comprising one of the sides of the main oven enclosure for permitting placement of items into the main oven enclosure, and permitting removal of items from the main oven enclosure; and leg members on the main oven enclosure to space the main oven enclosure a predetermined distance above a stove burner when the stove is in use to allow use of the stove burner to cook food thereon, wherein the leg members are movable from a storage position adjacent the main oven enclosure to an extended position designed to straddle a portable camp stove.

2. The combination according to claim 1 wherein the closable access door is hinged along one edge adjacent the top of the main oven enclosure.

3. The combination according to claim 2 further including an adjustable vent in the top of the main oven enclosure to permit varying amounts of air to travel therethrough.

4. The combination according to claim 3 wherein the leg members are hingedly attached to the bottom of the main oven enclosure for movement from a storage position adjacent the bottom of the main oven enclosure to an extended position designed to hold the main oven enclosure said predetermined distance above the stove burner.

5. The combination according to claim 4 wherein the main oven enclosure is made of metal.

6. The combination according to claim 5 further including a shelf in the interior of the main oven enclosure and spaced therein to permit air movement thereabout.

7. The combination according to claim 6 wherein the shelf comprises a removable shelf.

8. The combination according to claim 1 wherein the leg members are hingedly attached to the bottom of the main oven enclosure for movement from a storage position adjacent the bottom of the main oven enclosure to an extended position designed to hold the main oven enclosure said predetermined distance above the store burner.

9. The combination according to claim 1 further including an adjustable vent in the top of the main oven enclosure to permit varying amounts of air to travel therethrough.

10. The combination according to claim 9 wherein the main oven enclosure is made of metal.

11. The combination according to claim 10 further including a shelf in the interior of the main oven enclosure and spaced therein to permit air movement thereabout.

12. The combination according to claim 11 wherein the shelf comprises a removable shelf.

13. The combination according to claim 1 further including a shelf in the interior of the main oven enclosure and spaced therein to permit air movement thereabout.

14. The combination according to claim 13 wherein the shelf comprises a removable shelf.

* * * * *